United States Patent [19]

Lohrmann

[11] 4,225,869

[45] Sep. 30, 1980

[54] MULTISLOT BICONE ANTENNA

[75] Inventor: Dieter R. Lohrmann, Lanham, Md.

[73] Assignee: The United States of America as represented by the Secretary of the Army, Washington, D.C.

[21] Appl. No.: 24,234

[22] Filed: Mar. 26, 1979

[51] Int. Cl.[3] ..... H01Q 13/04

[52] U.S. Cl. ..... 343/773; 343/905; 343/774

[58] Field of Search ..... 343/773, 774, 775, 830, 343/884, 905

[56] References Cited

U.S. PATENT DOCUMENTS

| | | | |
|---|---|---|---|
| 2,175,252 | 10/1939 | Carter | 343/830 |
| 2,193,859 | 3/1940 | Buschbeck | 343/830 |
| 2,471,021 | 5/1949 | Bradley | 343/774 |
| 2,724,052 | 11/1955 | Boyer | 343/830 |
| 2,866,194 | 12/1958 | Stavis et al. | 343/774 |
| 3,159,838 | 12/1964 | Facchine | 343/774 |

*Primary Examiner*—Eli Lieberman

*Attorney, Agent, or Firm*—Nathan Edelberg; Robert P. Gibson; Saul Elbaum

[57] ABSTRACT

A compact multi-cone antenna is disclosed wherein quarter wavelength cones are utilized at each slot of a slotted ring antenna. The cones are selected to be quarter wavelength in order to provide an impedance transformation for better impedance matching with free space. The individual cones are chosen to have different characteristic impedances in order to provide the antenna with a sharp disc-like radiation pattern.

9 Claims, 10 Drawing Figures

MULTISLOT BICONE ANTENNA

RIGHTS OF THE GOVERNMENT

The invention described herein may be manufactured, used, and licensed by or for the United States Government for governmental purposes without the payment to me of any royalty thereon.

BACKGROUND OF THE INVENTION (1) Field of the Invention

The invention relates to antennas, and more particularly to slotted antennas having cones attached to the slots for radiation to free space.

(2) Prior Art

In Griffith Pat. No. 3,605,099, a plurality of devices is shown attached to a radiating antenna at slots formed in the outer conductor thereof. Each device comprises a tapered disc, formed as a triangle of revolution. Opposing halves of two adjacent devices form frustoconical reflecting elements for a radiating slot included therebetween. A coaxial transmission line having half-wavelength wide slots is utilized in '099, and the frustoconical elements are specifically required to be at least one wavelength in length, and preferably one and one-half wavelengths. The apparatus further requires specific elements, comprising probes 36 with universal joints 38, for matching the antenna transmission to the free space.

The present apparatus provides for a set of cones attached to a slotted antenna, but eliminates the requirement of such special matching elements. The present disclosure specifically provides for cones having quarter wavelength radii, whereby the cones act as impedance transformation devices for transforming the load impedance seen by the slot in the antenna to the impedance of free space.

A fundamental disclosure of a double cone antenna is found in Carter U.S. Pat. No. 2,175,252. Both bi-cone antennas and disc-cone antennas are disclosed in '252. However, no consideration is given to impedance matching as is contemplated in the present invention, or to the use of plural slots and varying cones as contemplated herein. Cones having a length of 0.23 wavelength are shown in '252 as one possibility, but this appears to be as a means for presenting substantially a resistance at the apices of the cones, and not to enable impedance matching of a specific load to a specific line.

Bradley U.S. Pat. No. 2,471,021 shows a slot cone antenna using a resonant cavity with a slotted cavity wall. Devices appearing to provide conical shapes are attached to the outer wall, but no consideration is given to the radial length of the cones to provide matching characteristics for the antenna. Use of a quarter wavelength cone in the present structure avoids the need of the resonators of '021.

Chu U.S. Pat. No. 2,486,589 discusses problems with the Carter '252 antenna, and provides improvement by shaping the antenna in the form of an apple core. Buchwalter et al U.S. Pat. No. 2,455,224 ulilizes a cylindrically shaped antenna having spaced annular regions of discontinuity, and provides flanges in the discontinuity spaces. No contemplation of the use of cones in the presently disclosed combination is found in either reference.

In summary, none of the prior art disclosures known to the inventor, singly or in combination, suggest the present invention as hereinbelow described and claimed.

SUMMARY AND OBJECTS OF THE INVENTION

Accordingly, it is a fundamental object of the invention to provide a compact antenna having a transmission characteristic matched to that of free space.

It is a further object of the invention to utilize a plurality of slots in an antenna, the slots associated with conical radiation devices.

Another object of the invention is to utilize quarter wavelength cones attached to an antenna in order to provide transmission characteristics matched with free space.

Yet a further object is the provision of a sharp radiation pattern with a minimum of side lobes by utilization of a plurality of cones associated with the slots of a slotted antenna, each cone having a specified angle in order to provide a characteristic impedance which cooperates with the other slots to provide the proper loading for the particular slot.

Another object of the invention is the use of a plurality of cones in a slotted antenna, the cones having differing angles to optimize and sharpen an antenna radiation pattern.

It is a further object to provide a transmission characteristic in a multiply slotted antenna which is varied among the slots, as required by the individual cones utilized thereon.

Yet another object is the utilization of an inner conductor in a coaxial transmission line having diameters which vary at each succeeding slot, each slot leading to a larger diameter of the conductor, thereby decreasing the effective characteristic impedance of the transmission line as seen beyond that slot.

In accordance with the preceding objects, a transmission line is disclosed having a plurality of slots therein, and conical elements attached to each slot.

The conical elements, or cones, are made to have a quarter wavelength radius from the outer conductor of the transmission line, in order to provide for impedance matching between free space and the line.

The cones are further provided with varying cone angles, in order to minimize the side lobe distribution and to provide a sharp antenna radiation pattern.

DETAILED DESCRIPTION OF THE INVENTION

In some applications it is desirable to utilize antennas having a radiation pattern which is rotationally symmetric and is as sharply disc-like as attainable.

Radar proximity fuzes, particularly as utilized in ballistic missiles, provide such applications. Specifically, if the radiation pattern is sharp and rotationally symmetric about the missile axis, a broad null will be provided in the direction of the target, thus overcoming electronic countermeasure transmissions emanating from the target towards the fuze. Moreover, the fuze receives return radar signals from the target only when flying past the target, and not during the approach thereto. Such applications also place a further premium on minimization of antenna size.

In microwave radiation regions such patterns and features may be achieved by the utilization of one or more slots in a waveguide.

Figure 1:
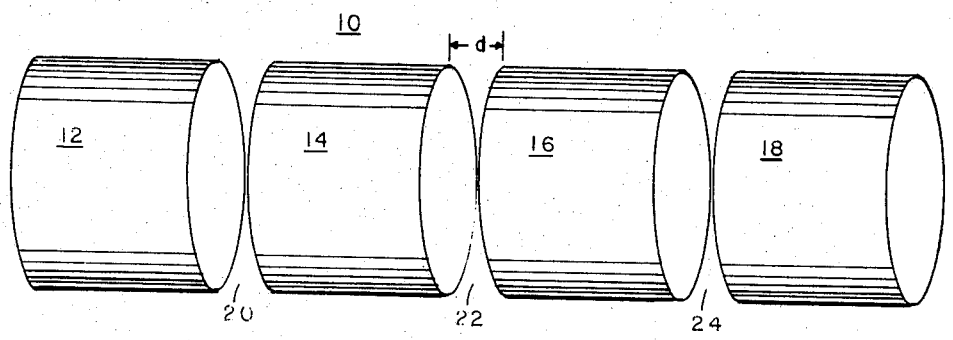
FIG. 1 is a multiply slotted cylindrical waveguide.

Referring now to FIG. 1, a waveguide is generally shown at 10, having a plurality of sections 12, 14, 16, and 18, separated by slots 20, 22 and 24, for example. The slots, providing a longitudinal displacement d between sections, cause the emission of electromagnetic radiation in a toroidal pattern about the axis of the waveguide. Such radiation is similar to that generated by Hertzian dipoles.

The radiation patterns associated with the several slots are cumulatively added to provide the resulting radiation pattern.

Associated with each slot is a radiation resistance which is proportional to the square of the slot gap, d. Moreover, the circular gap further possesses capacitive properties, and in fact simulates a series capacitor having a capacitance inversely proportional to the gap d.

Where the characteristic impedance of a waveguide, defined as the ratio of the electric to the magnetic field vectors therein, is approximately 200 ohms, operation at a ten centimeter wavelength with a slot gap of 1 millimeter yields a radiation resistance of approximately 0.06 ohms, very highly mismatched with the characteristic impedance. Simultaneously, a reactance of approximately 100 ohms is associated with the capacitance provided by the slot and the wave guide sections adjacent thereto. Thus, in order to increase the radiation resistance, the slot gap must be increased. Such an increase, however, also increases the capacitive reactance between these sections.

The structure hereinbelow described utilizes a bi-cone at the slot in order to provide an impedance transformation of the free space radiation impedance to a low resistance value seen at the slot.

Figure 2A:
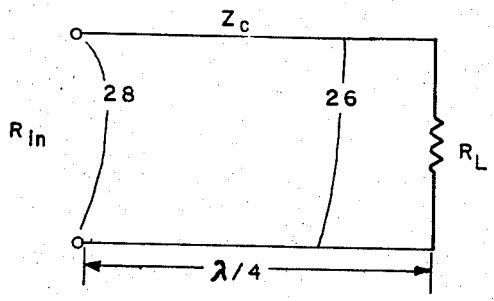
FIGS. 2A, B, C and D show the use of a quarter wavelength transmission line for matching purposes, and the development of a concept basic to the inventive structure therefrom.

Referring now to FIG. 2A for a description of the principle utilized in the present invention, a quarter wavelength transmission line is shown at 26. The line has a characteristic impedance Zc and is terminated by a load resistance RL. The resistance seen at the input terminals 28 is known to be given by equation 1.

$$Rin = Zc^2/RL \qquad (1)$$

Figure 2B:
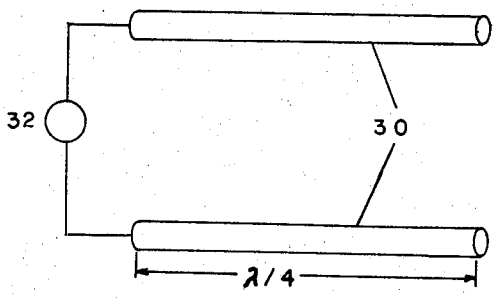
Figure 2C:
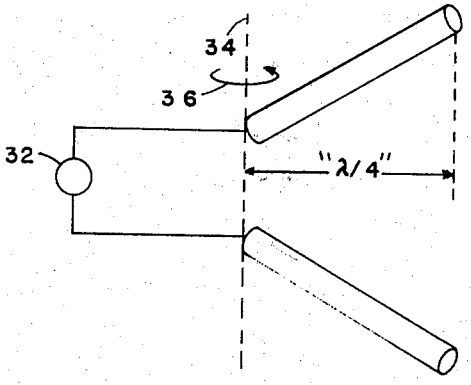
Figure 2D:
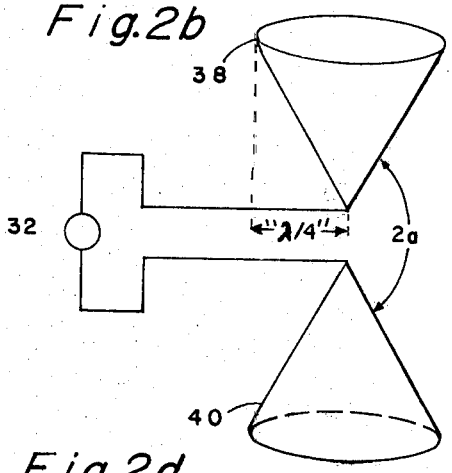

As shown in FIG. 2B, one may contemplate an open ended quarter wavelength transmission line 30 as transforming the free space radiation impedance of 377 ohms, seen at the open circuit end, to match the output resistance of a generator 32. If the elements of transmission line 30 are inclined from the horizontal as shown in FIG. 2C, and rotated about axis 34 as shown by arrow 36, a bi-cone radiating element as shown in FIG. 2D results. Each of cones 38 and 40 has a base radius of one quarter wavelength, as shown in the figure. Such a structure accordingly transforms the free space impedance by equation 1, where Zc is interpreted as the characteristic impedance of the bi-cone. Where the opening angles between cones is 2a, the input impedance of the cone, Ric, is given by approximate equation 2 below.

$$Ric = (2/3\pi)Z_oK^2 \tan^2 a \qquad a \leqq 45° \qquad (2)$$

In the preceding equation, the $Z_o$ is the characteristic impedance of open space, given by 377 ohms.

K is a constant dependent upon the radius of the waveguide used in conjunction with the bi-cone, and on the free space wavelength.

The simplified explanations described herein are intended to provide a basic understanding of the Physics involved. Exact solutions are derived by Maxwell's Equations in Schelkunoff, Journal of Applied Physics 22/1951, pages 1330/32 and results of practical measurements were published in Brown et al, RCA Review, Vol. 13 No. 4, page 425, Dec., 1952. These publications are incorporated herein by reference. These solutions show that for increasing cone length, the reactive part of the input impedance disappears at lengths shorter than lambda/4. For instance, the Brown et al publication shows that for a cone opening angle of 90°, the radial length of the cone for which the reactive part disappears for the first time (called "lambda quarter length") is mechanically not at 0.25 lambda, but at 0.09 lambda, and this value varies with the opening angle. Therefore, in the following text and drawings, "λ/4 length" is placed in quotation marks in order to denote the electrical length rather than the mechanical. The actual mechanical length is easily derived with the aid of nomographs or calculations as found in the above-mentioned references.

The bi-cone shown in FIG. 2D and having the input resistance given by equation 2 is utilized in conjunction with the slot of FIG. 1. Since the present structure is not necessarily a resonating cavity, concern with resonator losses is minimized, and an easily excited TM01 wave may be used. Devices using resonating cavities require the use of the more difficult to excite TE01 wave because of the lower resonator loss characteristics of such a wave.

Figure 3:
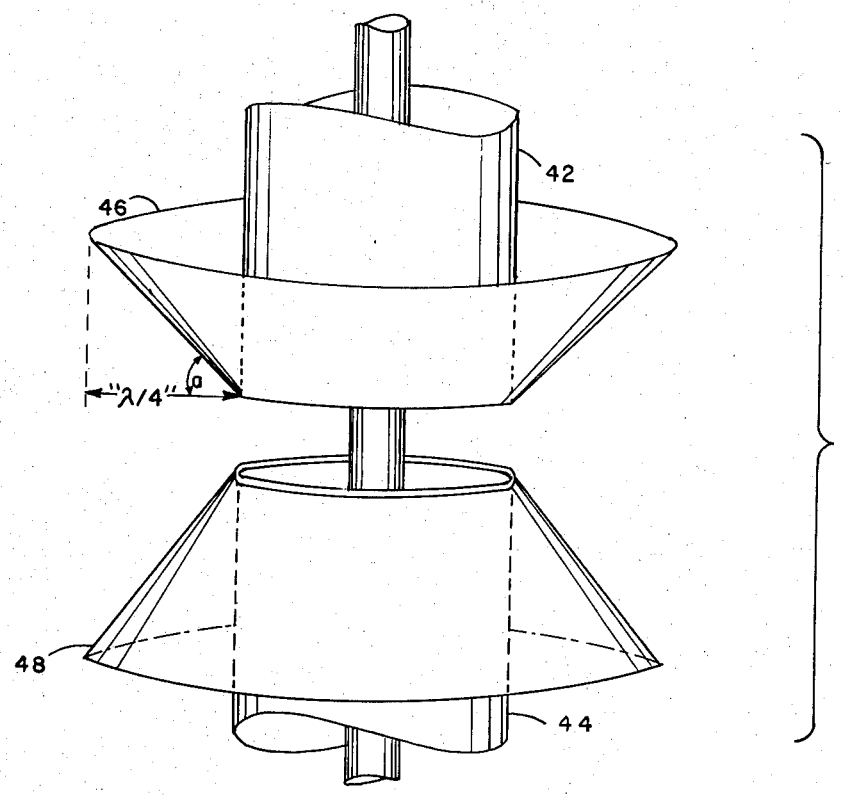
FIG. 3 illustrates a bi-cone reflector associated with a slot in a transmission line.

A standard coaxial cable may be used for the transmission line as well as the waveguide previously contemplated, however, the usual transmission mode in a coaxial cable is the TEM mode, which also has currents in the axial direction on the outer conductor of the cable. FIG. 3 shows, in perspective, a bi-cone associated with a slot in a coaxial conductor. Specifically, outer conductor segments 42 and 44 of a coaxial cable having a slot therein are shown with fructoconical segments 46 and 48 attached thereto. The frustoconical segments, in accordance with the present invention, extend an electrical quarter wavelength beyond the outer conductor of the coaxial line. That is, the base radius for each of the frustoconical segments is "one-quarter wavelength" larger than the radius of the truncated apex. The opening angle between the two segments 46 and 48 is 2a, and the slot gap width is given by d. The use of "quarter wavelength" bi-cones provides for smaller dimensioned antennas than available in the prior art, where cones having lengths of 1 to 1½ wavelengths are suggested.

Figure 4:
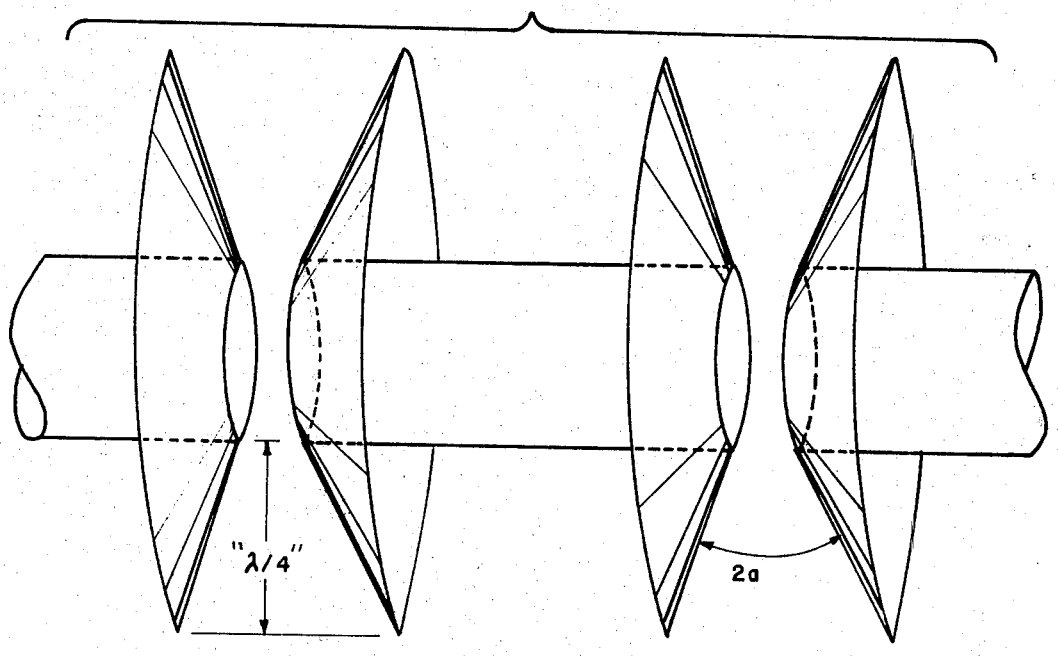
FIG. 4 illustrates the multi-slot bi-cone antenna of the present invention.

A plurality of bi-cones associated with a multi-slot antenna is shown in FIG. 4.

As evidenced in equation 2, the cone resistance Ric associated with each bicone is related to the opening angle 2a. However, the power radiated by a particular bi-cone is $$Pr = Ric\ I^2 \quad (3)$$

where I is the current on the transmission line.

Therefore, by selecting angle a for each bi-cone, the power transmitted by that particular bi-cone can be varied, i.e., weighted with respect to the other bi-cones. One well-known way to obtain small sidelobes is to use cosine square weighting of the radiators. The result of proper design of the opening angles of the bi-cones in the assembly is a sharp, flattened radiation pattern from the antenna, approaching the flat disc pattern with a minimum of undesirable sidelobes.

The bi-cones are inserted in series in the transmission line. Thus, where the signal travels from slot K to slot K+1, and where the impedance seen at slot K+1 is given by Z(K+1) and the input impedance of the bi-cone at slot (K+1) is Zi(K+1), an impedance match would require that the characteristic line impedance seen looking toward slot k, designated by Z(k), be given by equation 4.

$$Z(k) = Zi(k+1) + Z(k+1) \quad (4)$$

Such a variation in the line characteristic impedance may be achieved by using a central conductor having a smaller diameter at slot k than at slot k+1. Alternatively, an outer conductor having a larger diameter at slot k than at slot k+1 would provide a similar alteration of the characteristic impedance. Such variations in the dimensions of the coaxial cable are shown in FIGS. 6A and B. In FIG. 6A it is seen that central conductor 62 increases in diameter at slot k, and again at slot k+1, while outer conductor 64 is maintained at a constant diameter. In FIG. 6B, central conductor 66 remains at a constant diameter, while outer conductor 18 decreases in diameter at each slot.

As an example of the orders of magnitude involved, the input impedance of the cone Ric as given in equation 2 is calculated for a coaxial cable having a 10 millimeter diameter.

As previously discussed, the parameter K is a constant dependent upon the ratio of waveguide radius to the free space wavelength. For a 10 GHz wave the wavelength is 3 centimeters. For this specific example, this ratio is then $$5\ \text{mm}/3\ \text{cm} = 0.17$$

for which K is 0.46. Assuming an opening angle of 60°, then angle a is 30° and it follows from equation 2 that $$Ric = 5.6\ \text{ohms}.$$

Assuming the bi-cone is applied to a slot in a 50 ohm coaxial line, it is seen that $$5.6/(50+5.6) = 10\%$$

of the power will be radiated by the cone.

For the present example it is shown below that the power reflection coefficient $r^2$ representing the ratio of the power reflected to the power output from the generator, is negligible. Specifically, $$r^2 = (Ric)^2/[2Z_o + Ric]^2 = (5.6/105.6)^2 = 0.0028 \quad (5)$$

Figure 5A:
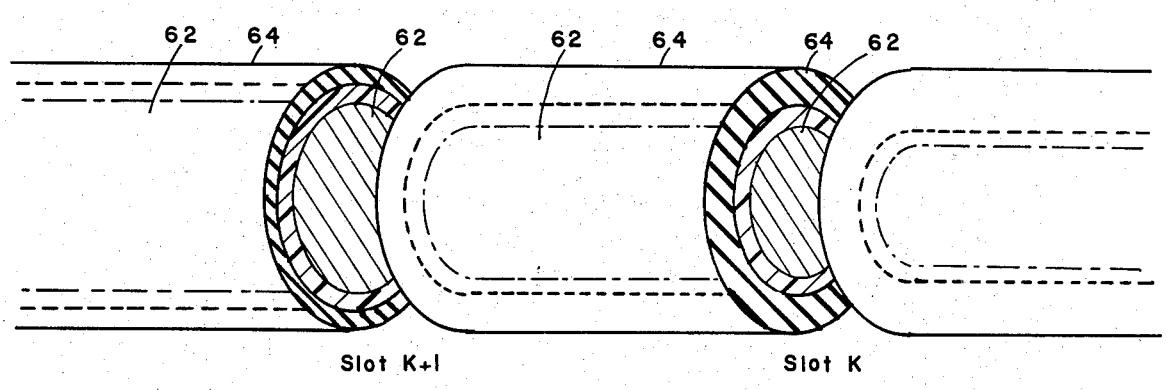
FIGS. 5A and B show structures useful for adjustment of characteristic impedance of a transmission line to overcome mismatches caused by insertion of a reflecting cone.
Figure 5B:
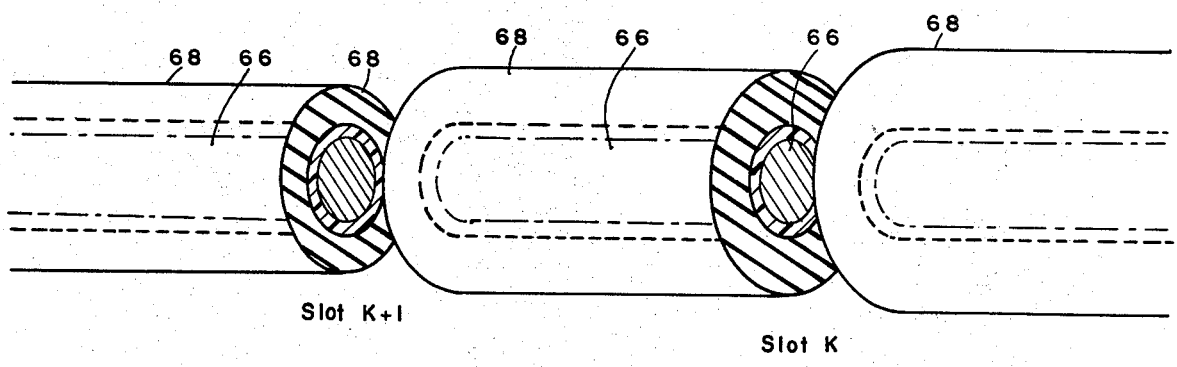

Thus, while approximately 10% of the power is radiated by the cone, 0.28% will be reflected back to the source, a negligible figure. However, for even better matching, the characteristic impedance of the coaxial line segment behind the cone may be decreased in order to match the resistance of the cone in addition to that of the following line segment. Thus, in the present example, a line segment having a 44.4 ohm characteristic impedance would provide the desired better matching. This may be obtained as previously described and as shown at FIGS. 5A and B by slightly increasing the radius of the center conductor in a coaxial line, or by slightly decreasing the radius of the outer conductor of the coaxial line, behind the cone.

Figure 6:
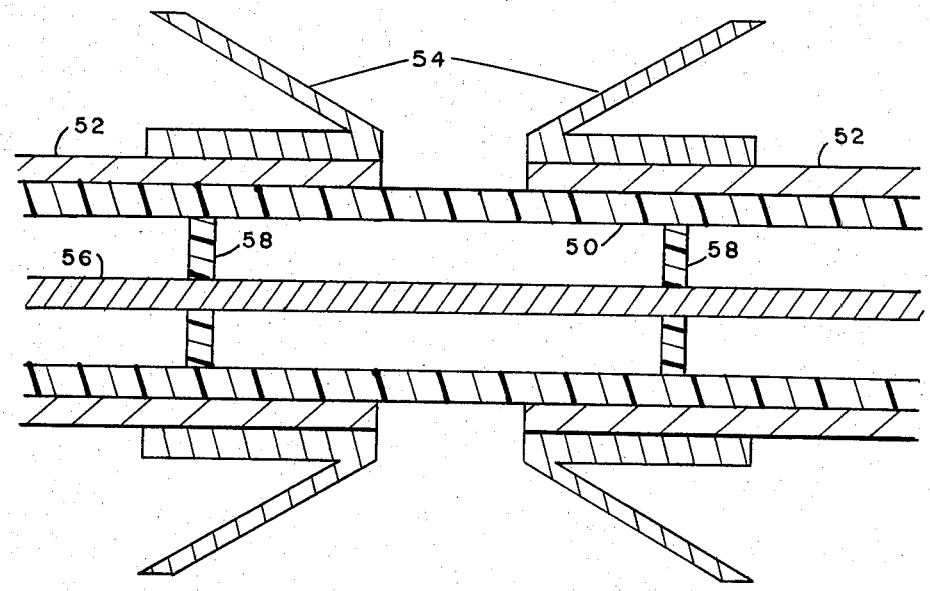
FIG. 6 shows yet another embodiment of the present invention.

For mechanical ease in application of the present invention to a hollow waveguide, a plastic pipe may be utilized with a metal coating applied thereto, the metal coating having periodic interruptions in the form of rings to provide the "slots". The metal coating may, for example, be metalization sprayed on to the pipe. Additionally, the invention may further be embodied by a plastic pipe having the metal coating thereon with a center conductor. The center conductor is supported by discs extending to the outer plastic pipe. Of course, while plastic is described herein, other rigid dielectric materials may similarly be used. This embodiment of the invention is shown in FIG. 6 wherein a plastic pipe 50 is shown with a metal layer 52 and with a bi-cone 54 mounted at an opening in layer 52. A center conductor 56 is supported by discs 58 within pipe 50.

The preceding disclosure has provided several embodiments of the invention utilizing a "quarter wavelength" bi-cone in conjunction with a multi-slot transmission line.

I wish it to be understood that I do not desire to be limited to the exact details of construction shown and described, for obvious modifications can be made by a person skilled in the art.

I claim:

1. An antenna comprising:

(a) wave conducting means having a characteristic impedance;

(b) a plurality of interruptions in the form of a slot in said wave conducting means for radiating electromagnetic waves;

(c) matching means associated with said interruptions for providing impedance transformation of free space transmission impedance to a value more compatable with said characteristic impedance of said wave conducting means, said matching means comprising bi-conical segments having a predetermined opening angle and extending from said wave conducting means substantially by one-quarter electrical wavelength; and (d) means for shaping the radiation pattern of said antenna to minimize side lobes and to provide a flattened disc-like radiation pattern comprising a plurality of said bi-conical matching means associated with at least two of said plurality of interruptions, said at least two bi-conical matching means having different opening angles and thereby having differing characteristic impedances, for achieving said disc-like radiation pattern.

2. An antenna as recited in claim 1, wherein said wave conducting means comprises coaxial transmission means having at least two segments with differing characteristic impedances.

3. An antenna as recited in claim 2 wherein said at least two segments have conductors of differing dimensions for providing said differing characteristic impedances of said segments.

4. An antenna as recited in claim 1, wherein said wave conducting means comprises a hollow conducting means having a transverse dimension, and wherein said bi-conical segments comprise frustoconical sections associated with said hollow conducting means, the radius of the small cross-section of said frustoconical sections matching said transverse dimension of said wave conducting means, and the radius of the larger cross-section of said frustoconical sections being substantially one-quarter electrical wavelength larger than the radius of the small cross-section.

5. An antenna as recited in claim 4 wherein a TM01 wave is propagated along said wave conducting means.

6. An antenna as recited in claim 4 wherein said hollow conducting means comprises an interrupted metallic coating on a non-conducting structure.

7. An antenna as recited in claim 6 further comprising a central conductor within the non-conducting structure and means attaching said central conductor to said non-conducting structure.

8. An antenna as recited in claim 1 wherein said wave conducting means comprises coaxial transmission means.

9. An antenna as recited in claim 1 wherein said wave conducting means includes:

(a) a plurality of slotted interruptions, each associated with bi-conical segments, and (b) dielectric material therein for providing a proper phase relationship at each of said bi-conical segments and for providing structural support therefor.

* * * * *